United States Patent [19]

Darsie

[11] 4,006,759

[45] Feb. 8, 1977

[54] LOCKED TOGGLE BEATER DRIVE FOR TRIAXIAL WEAVING MACHINE

[75] Inventor: Burns Darsie, Rockford, Ill.

[73] Assignee: Barber-Colman Company, Rockford, Ill.

[22] Filed: Apr. 21, 1976

[21] Appl. No.: 678,943

[52] U.S. Cl. ..... 139/191; 139/DIG. 1

[51] Int. Cl.² ..... D03D 49/68; D03D 41/00

[58] Field of Search ..... 139/11, DIG. 1, 188, 139/190, 191

[56] References Cited

UNITED STATES PATENTS

| | | | |
|---|---|---|---|
| 1,184,790 | 5/1916 | Trautvetter | 139/DIG. 1 |
| 2,085,455 | 6/1937 | Sigel | 139/191 |
| 2,471,354 | 5/1949 | Shimwell | 139/191 |
| 3,799,209 | 3/1974 | Dow et al. | 139/DIG. 1 |

*Primary Examiner*—Henry S. Jaudon
*Attorney, Agent, or Firm*—A. Richard Koch

[57] ABSTRACT

In making triaxial fabric, the warp strands cross each other so that different positions for the beaters are required for successive insertions of weft strands. One of two beaters holds the fell until the other is ready to come down. In order to stabilize the position of the beater bar in the beat-up position, two toggle links in the beat-up linkage are maintained in aligned compression, so that the effective number of links is reduced by one.

8 Claims, 2 Drawing Figures

LOCKED TOGGLE BEATER DRIVE FOR TRIAXIAL WEAVING MACHINE

BACKGROUND OF THE INVENTION

This invention pertains to machines for forming triaxial fabric and more particularly to beat-up motions therein.

Triaxial weaving machines are disclosed in U.S. Pat. No. 3,799,209, issued to Norris F. Dow and Murray Halton on Mar. 26, 1974, and 3,884,429, issued to Norris F. Dow on May 20, 1975. In such machines the strands in one warp sheet are shifted laterally in one direction, while strands in the other warp sheet are shifted laterally in the opposite direction after each shedding operation. This warp shifting results in different beater positions and makes necessary two beaters acting alternately. One beater engages the fell until the other beater is ready to come down with its fingers between a different set of warp strands. A beater has its fingers entered between adjacent strands in each warp sheet, moved downward through the warp sheets and against the fell, where it is held until the other beater is ready to come down, at which time it is withdrawn and raised to its initial position. Linkages employed in the past to accomplish this motion have not held the fingers in a stable position against the fell, resulting in imperfectly woven fabric.

SUMMARY OF THE INVENTION

By redesigning the beat-up mechanism to change the relationship of certain links, a beater is held firmly against the fell until it is withdrawn. By employing toggle links maintained in aligned compression while the beater engages the fell, a stable position of the beater is assured. The position of the linkage is determined by cams.

DESCRIPTION OF THE PREFERRED EMBODIMENT

Figure 2:
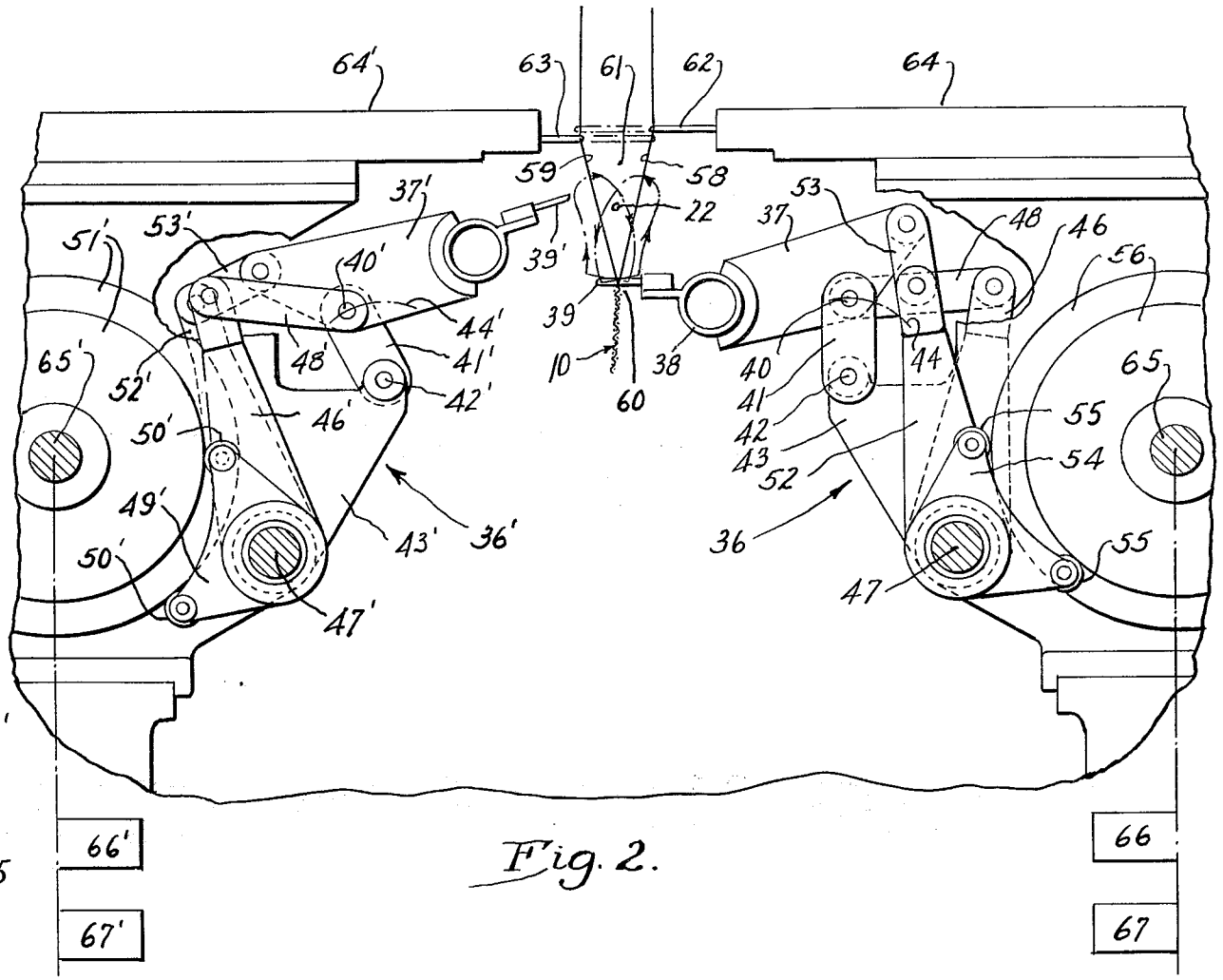
FIG. 2 is an elevation of a beater drive in accordance with this invention and showing the relationship of two beater drives to the heddles and the weft insertion in a triaxial weaving machine.
Figure 1:
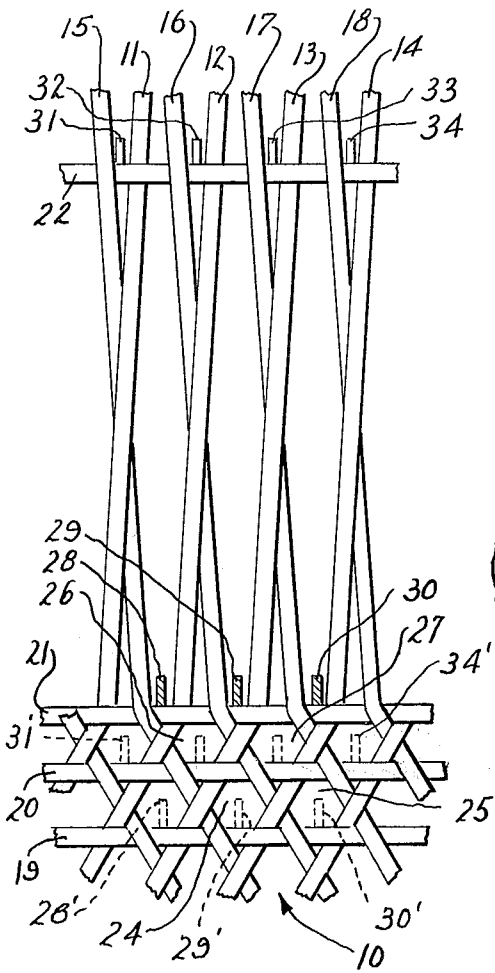
FIG. 1 shows a fragment of fabric formed on a triaxial weaving machine and the different alternative positions of the fingers of two beaters employed in the forming thereof.

As shown in FIG. 1, a typical triaxially formed fabric 10 comprises a first sheet of warp strands 11, 12, 13, 14 moving from left to right as the fabric is formed from the bottom up. A second sheet of warp strands 15, 16, 17, 18 moving from right to left as the fabric is formed lies behind the first sheet. The fill yarn, 19, 20, 21, 22 are woven over the warp strands 11, 12, 13, 14 in the first sheet and under the warp strands 15, 16, 17, 18 in the second sheet, producing staggered hexagonal openings 24, 25, 26, 27. It will be seen that beater fingers 28, 29, 30 and 31, 32, 33, 34 beating-up the fill threads must be similarly staggered. Earlier positions of the fingers with respect to the formed fabric are shown in dashed lines, some being identified by primes. One set of fingers 28, 29, 30 is shown as holding fill yarn 21 in beat-up position, while the other set of fingers 31–34 is shown engaging fill yarn 22 preparatory to beating it up. As shown the set of fingers 28–30 enter from the front of the fabric 10, while the fingers 31–34 enter from the back of the fabric.

A beater drive 36 according to this invention comprises a beater bar arm 37, upon which a beater bar 38 may be adjustably mounted. A reed 39 having fingers 28–30, etc. extending therefrom is rigidly connected to the beater bar. As shown, the beater bar arm is pivotally mounted on a movable fulcrum 40 on the free end of a pivot link 41, pivotally mounted on a fixed fulcrum 42 on a frame 43 so that the fulcrum 40 is constrained to move in a fixed arcuate path 44. A beater arm 46 is pivoted on a fixed axis 47 on frame 43 and is coupled at its free end through a connecting link 48 to the pivot link 41 to locate the movable fulcrum 40 along its path 44. The instantaneous position of beater arm 46 is determined in the same manner as is the position in a second beater drive 36' of beater arm 46', which is established by a cam follower 49' in fixed relation to arm 46' and having thereon rollers 50' engaging a double acting cam 51'. A second beater arm 52 is pivoted on a fixed axis, shown for convenience and to reduce the number of components as the axis 47 on which the other beater arm 46 is also pivoted. The free end of the beater arm 52 is coupled through a toggle link 53 to beater bar arm 37 at a point remote from fulcrum 40. A second cam follower 54 in fixed relation to arm 52 and having thereon rollers 55 engaging a second double acting cam 56 determines the position of the beater arm 52.

The second beater drive 36' is located on the opposite side of the fabric 10 and is of identical construction, so the same reference numericals with primes have been used to identify like parts.

It will be obvious to those skilled in the art that the fixed path 44 followed by movable fulcrum 40 could be defined in other ways and that its instantaneous position along the path could be established by other means. The positioning of beater arm 52 could likewise be programmed by other means.

OPERATION

In general the reed 39 is caused to move in a somewhat ovate path. At the beginning of the beat-up motion the reed is in a raised position outside the shed formed by warp sheets 58, 59. The fingers 28–30 are moved between the warp strands 11–14 in sheet 58 and between the warp strands 15–18 in sheet 59 primarily as a result of movement of fulcrum 40 by beater arm 46 in response to changes in the profile of cam 51. As the toggle formed by beater arm 52 and toggle link 53 is straightened in response to changes in the profile of cam 56, the reed 39 is brought down against and exerts a great force upon the fell 60 of fabric 10 being formed. The reed is maintained in beat-up position until the other beater drive 36' is ready to move its reed 39' into beat-up position, at which time the fingers 28–30 are withdrawn by breaking of the toggle link to provide an upward movement component in response to changes in the profile of cam 56 and by movement of fulcrum 40 away from the fabric 10 through motion of beater arm 46 in response to change in the profile of cam 51. Finally the reed is returned to its initial position by additional movement of beater arm 52. Those acquainted in the art will know how to profile the cams 51, 56 in order to produce the required motion of the reed 39.

The motions of the beater drives 36, 36' are synchronized so that they alternately beat-up the fell 60. The formation of the shed 61 by reciprocatory coordinated longitudinal motion of rows of heddles 62, 63 guiding the individual strands 11–14, 15–18 in warp sheets 58, 59 respectively is accomplished by shedding mechanisms 64, 64', which are synchronized with the beater drives 36, 36' through positive drives from commonly driven shafts 65, 65', to which cams 51 (not shown), 56, 51', 56' (not shown) are keyed. Synchronization of the opposite lateral shifting movement of warp strands in the sheets 58, 59, by shifting mechanism 66, 66', the transfer of warp strands from the leading edge of one sheet to the trailing edge of the other by transfer mechanisms 67, 67' and the insertion of the fill thread 22 is not shown in detail, since it is not required for an understanding of this invention. Suitable shifting and transfer mechanisms are disclosed in our copending patent applications Ser. No. 603,657 filed on Aug. 11, 1975 by Kulczycki and Ser. No. 603,756, filed on Aug. 11, 1975 by Kulczycki and Darsie.

The described embodiment is exemplary only. The terms used in the description are used in a generic sense and not as limitations.

I claim:

1. A beater drive for a reed beating-up the fill threads by movement of the reed toward and away from the fell of a fabric being woven in a weaving machine, said drive comprising a fulcrum, means for moving said fulcrum along a fixed path toward and away from said fabric, a beater bar arm pivoted on said fulcrum, a beater arm pivoted about a fixed axis, means for variably positioning said beater arm in a predetermined program about said axis, and a toggle link coupling the beater bar to said beater arm, said moving and positioning means cooperating when the reed is in beat-up position against the fell such that the toggle link and the beater arm are maintained in substantially aligned compression.

2. A beater drive according to claim 1 wherein said positioning means comprises a cam follower in fixed relation to said beater arm and a cam engaged by the cam follower.

3. A beater drive according to claim 1 further comprising a pivot link connecting said movable fulcrum and a fixed fulcrum to define said path.

4. A beater drive according to claim 3 wherein said moving means comprises a second beater arm pivoted about a second fixed axis, a connecting link between said pivot link and the second beater arm and means for controlling the position of said second beater arm.

5. A beater drive according to claim 4 wherein said first and second fixed axes are coextensive.

6. A beater drive according to claim 4 wherein said moving means further comprises a cam follower in fixed relation to said second beater arm and a cam engaged by the cam follower.

7. A beater drive according to claim 4 wherein said positioning and controlling means are synchronized to produce a substantially ovate movement of the reed.

8. A beater drive according to claim 1 located on one side of the fabric being woven, another beater drive according to claim 1 located on the opposite side of the fabric and means for synchronizing operation of said beater drives such that the beater drives act alternately to beat-up the fell.

* * * * *